US006332499B1

(12) United States Patent
Kobylinski et al.

(10) Patent No.: US 6,332,499 B1
(45) Date of Patent: Dec. 25, 2001

(54) DEPLOYMENT TUBING CONNECTOR HAVING INTERNAL ELECTRICAL PENETRATOR

(75) Inventors: Lee S. Kobylinski; John C. Pursell, both of Bartleville, OK (US); Howard A. Oswald, Lawrence, KS (US); Marcus D. McHugh, Lawrence, KS (US); Pinke Halpert, Lawrence, KS (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/447,990

(22) Filed: Nov. 23, 1999

(51) Int. Cl.[7] ..... E21B 17/20; H01R 24/02

(52) U.S. Cl. ..... 166/65.1; 166/242.6; 439/195

(58) Field of Search ..... 166/380, 385, 166/387, 66.4, 65.1, 65.4, 242.6; 439/194, 195, 191

(56) References Cited

U.S. PATENT DOCUMENTS

| | | | |
|---|---|---|---|
| 509,603 | 11/1893 | Noll . | |
| 1,188,485 | 6/1916 | Pruyn . | |
| 1,797,691 | 3/1931 | Merrill . | |
| 2,748,358 | 5/1956 | Johnston . | |
| 4,003,435 | 1/1977 | Cullen et al. . | |
| 4,530,527 | 7/1985 | Holmberg . | |
| 4,616,537 | 10/1986 | Axford et al. | 82/5 |
| 4,660,910 | 4/1987 | Sharp et al. . | |
| 4,690,212 | 9/1987 | Termohlen | 166/65.1 |
| 4,759,406 | 7/1988 | Smith et al. | 166/65.1 |
| 4,942,926 | 7/1990 | Lessi . | |
| 4,945,995 | 8/1990 | Tholance et al. . | |
| 4,997,384 | 3/1991 | Godfrey et al. . | |
| 5,060,737 | 10/1991 | Mohn . | |
| 5,115,484 | 5/1992 | Johnson | 385/72 |
| 5,122,209 | 6/1992 | Moore et al. . | |
| 5,219,298 | 6/1993 | Morin et al. | 439/192 |
| 5,297,943 * | 3/1994 | Martin | 417/422 |
| 5,348,492 | 9/1994 | Sonnet . | |
| 5,377,747 | 1/1995 | Didier | 166/65.1 |
| 5,524,937 | 6/1996 | Sides, III et al. | 285/133.1 |
| 5,954,483 * | 9/1999 | Tetzlaff | 417/360 |
| 6,116,337 * | 9/2000 | Civarolo et al. | 166/65.1 |
| 6,138,765 * | 10/2000 | Russell et al. | 166/387 |
| 6,143,988 * | 11/2000 | Neuroth et al. | 174/105 R |

FOREIGN PATENT DOCUMENTS

| | | | |
|---|---|---|---|
| 0 612 913 | 8/1994 | (EP) | E21B/17/02 |
| 2 167 616 | 6/1986 | (GB) | H02G/15/10 |
| 2 327 441 | 1/1999 | (GB) | E21B/17/20 |
| 2 340 155 | 2/2000 | (GB) | E21B/17/20 |

* cited by examiner

*Primary Examiner*—Frank Tsay
(74) *Attorney, Agent, or Firm*—Fletcher, Yoder & Van Someren

(57) ABSTRACT

A connector for use in a deployment system able to deploy and power a device, such as an electric submergible pumping system, in a well. The connector includes pluggable ends that permit connection adjacent segments, each having an outer section of tubing and an internal power cable. Each connector includes a tubing connector portion and a power cable connector portion that permit pluggable connection of sequential tubing segments when deploying a device or system downhole.

17 Claims, 5 Drawing Sheets

DEPLOYMENT TUBING CONNECTOR HAVING INTERNAL ELECTRICAL PENETRATOR

FIELD OF THE INVENTION

The present invention relates generally to a system for deploying well-related equipment, such as electric submergible pumping systems, and particularly to a connector that permits secure connection of segments of combined external deployment tubing and internal power cable.

BACKGROUND OF THE INVENTION

A variety of systems are used for deploying equipment used in the production of fluids, such as oil, from producing wells. For example, tubing has commonly been used for the deployment of downhole equipment. Electric submergible pumping systems, for instance, may be deployed by appropriate deployment tubing to a desired location within a wellbore. Depending on the application, the production fluid is produced either through the center of the tubing or through the annulus formed between the tubing and the wellbore casing.

When deploying systems, such as electric submergible pumping systems, it is necessary to provide power to the system. Accordingly, a power cable is connected between a power supply at the surface and a submergible electric motor of the electric submergible pumping system. The power cable generally is either tied to the outside of the tubing or routed through the center of the tubing. For example, if the production fluid is produced through the annulus formed around the deployment tubing, it is convenient to provide power cable through the center of the tubing.

One type of commonly used tubing is coiled tubing. Coiled tubing may be transported in rolls that are unrolled during deployment of the downhole system for relatively rapid and convenient deployment of the system, e.g. an electric submergible pumping system. For certain applications, a power cable is disposed in the center of the coiled tubing. by way of example, Reda of Bartlesville, Okla., a division of Schlumberger Corporation, manufactures REDACoil™, a product in which power cable is prepackaged within coiled tubing. Repairing or connecting lengths of coiled tubing with internal power cable can be difficult, particularly when the splice is made in the field.

Also, the coiled tubing and internal power cable generally are formed in the lengths necessary to accommodate deployment of the electric submergible pumping system to a desired location within a wellbore. However, extremely long lengths of tubing and power cable can be difficult to handle, and the equipment used to deploy downhole systems may be limited to a given length of tubing.

In certain applications, e.g. deep wells, and in certain situations in which the deployment tubing requires repair, it would be advantageous to have a connector system that permitted a relatively simple combination of independent segments of tubing, particularly coiled tubing having a combined power cable.

SUMMARY OF THE INVENTION

The present invention features a connector system for connecting sections of tubing used in deploying a downhole device for production of fluid from a well. The connector system includes a tubing connector having an upper nipple section sized for receipt in a first tubing end. The tubing connector also includes a lower nipple section sized for receipt in a second tubing end. The tubing connector also includes a hollow interior for receiving an electrical feed-through. The electrical feed-through has a first connection end, a second connection end and a plurality of conductors extending between the first and the second connection ends. The tubing connector and the electrical feed-through provide for ready connection of segments in a modular deployment system.

According to another aspect of the invention, a coiled tubing connection system is provided. The system includes a first segment of coiled tubing having a first connector end and a first hollow interior. The system also includes a first power cable disposed in the hollow interior and having a first plug proximate the first connector end. A second segment of coiled tubing has a second connector end and a second hollow interior. Also, a second power cable is disposed in the second hollow interior and has a plug proximate the second connector end. The system further includes a coiled tubing connector having a housing sized to selectively engage the first connector end and the second connector end. The coiled tubing connector further includes an internal plug assembly positioned to conductively engage the first plug and the second plug when the first and second connector ends are engaged with the coiled tubing connector.

According to another aspect of the invention, a connector is provided for use in wellbore environments to connect segments of a tubing-style deployment system. The connector includes an outer housing having a pair of connection ends positioned to connect two consecutive sections of tubing in a wellbore. Additionally, the connector includes an internal electrical connector assembly disposed within the outer housing to electrically couple a power cable deployed within the two consecutive sections of tubing.

BRIEF DESCRIPTION OF THE DRAWINGS

The invention will hereafter be described with reference to the accompanying drawings, wherein like reference numerals denote like elements.

DETAILED DESCRIPTION OF THE PREFERRED EMBODIMENTS

Figure 1:
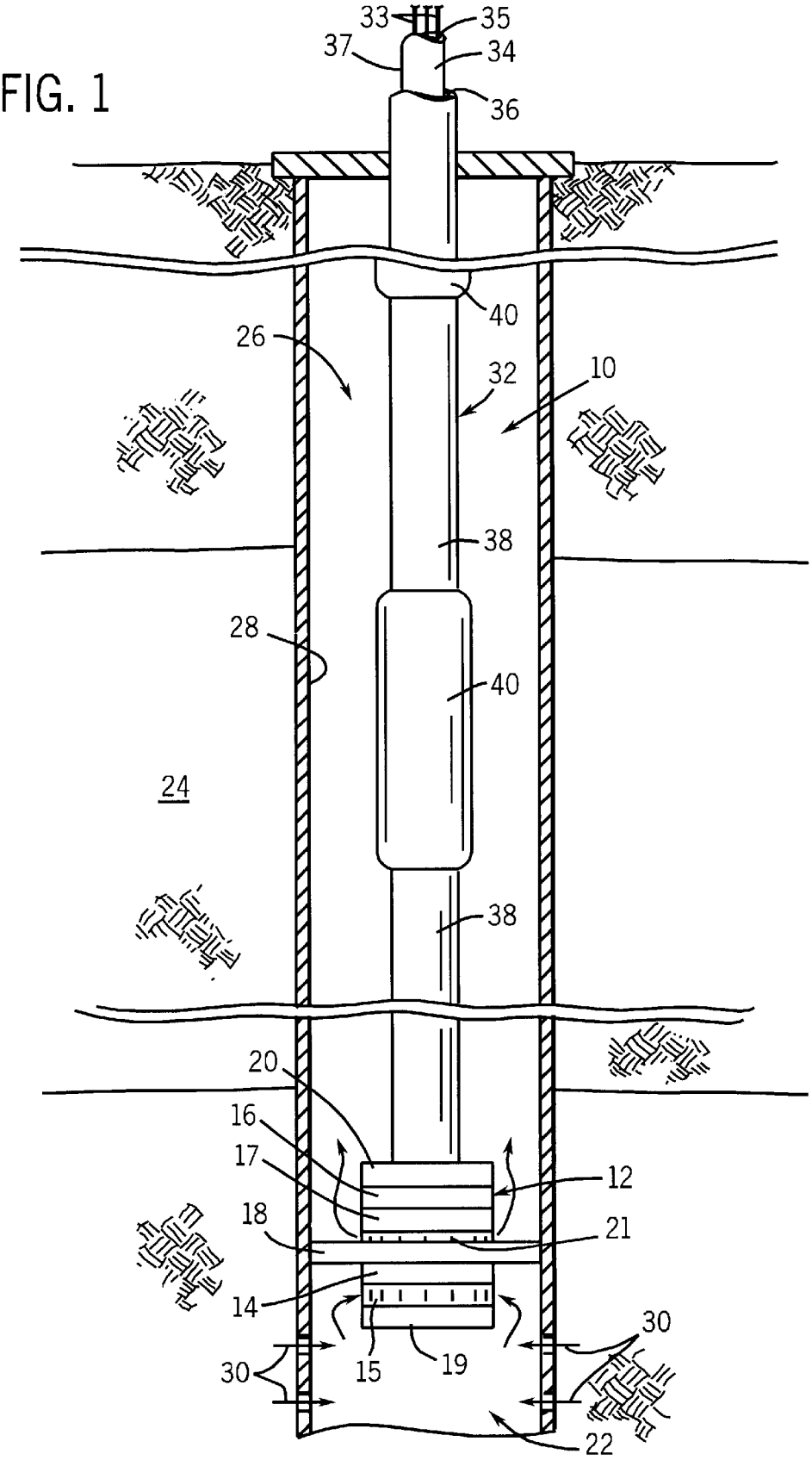
FIG. 1 is a front elevational view of an exemplary deployment system, deploying an electric submergible pumping system, according to a preferred embodiment of the present invention.

Referring generally to FIG. 1, an exemplary deployment system 10 is illustrated in a wellbore environment. Deployment system 10 is attached to an electric submergible pumping system 12 and preferably a bottom intake system. Deployment system 10 can be utilized in the deployment of a wide variety of devices or systems, but the unique design of deployment system 10 is particularly amenable to deployment of electric submergible pumping systems 12.

A typical bottom intake pumping system 12 may comprise a variety of components depending on the particular application or environment in which it is used. Typically, system 12 includes at least a submergible pump 14, a pump intake 15, a submergible motor 16, a motor protector 17 and a packer assembly 18. However, a variety of other or additional components can be utilized in the system.

For example, system 12 may include a thrust section 19 and a connector 20 by which submergible pumping system 12 is coupled to deployment system 10. Also, a variety of component types may be utilized. For instance, an exemplary motor 16 is a three-phase, induction-type motor, and an exemplary pump 14 is a multi-stage centrifugal pump. In this type of system, submergible pump 14 draws wellbore fluid through pump intake 15 and discharges it through a packer discharge head 21 above the packer assembly 18 into the annulus formed about deployment system 10. A variety of packer assemblies also may be utilized, such as a mechanically set packer or a hydraulic packer, such as the Camco HRP-1-SP Hydraulic Set Packer available through Camco of Houston, Tex.

In the example illustrated, system 12 is designed for deployment in a well 22 within a geological formation 24 that contains desirable production fluids, such as petroleum. In a typical application, a wellbore 26 is drilled and lined with a wellbore casing 28. Wellbore casing 28 may include a plurality of openings 30, often called perforations, through which production fluids flow into wellbore 26.

Although deployment system 10 may have a variety of forms and configurations, it typically comprises tubing, and preferably two or more sections of coiled tubing 32. A power cable 34 is disposed within a hollow interior 36 of the tubing 32. The power cable 34 is supported within tubing 32 by appropriate anchors, buoyancy fluid or other means. Power cable 34 often includes at least three conductors 33 surrounded by one or more layers of insulation 35 and an outer protective armor 37.

As illustrated, deployment system 10 comprises two or more segments 38 connected by one or more connector systems 40. Each segment 38 includes an outer tube, e.g. a section of coiled tubing 32, and a combined power cable, such as an internal power cable 34.

Figure 2:
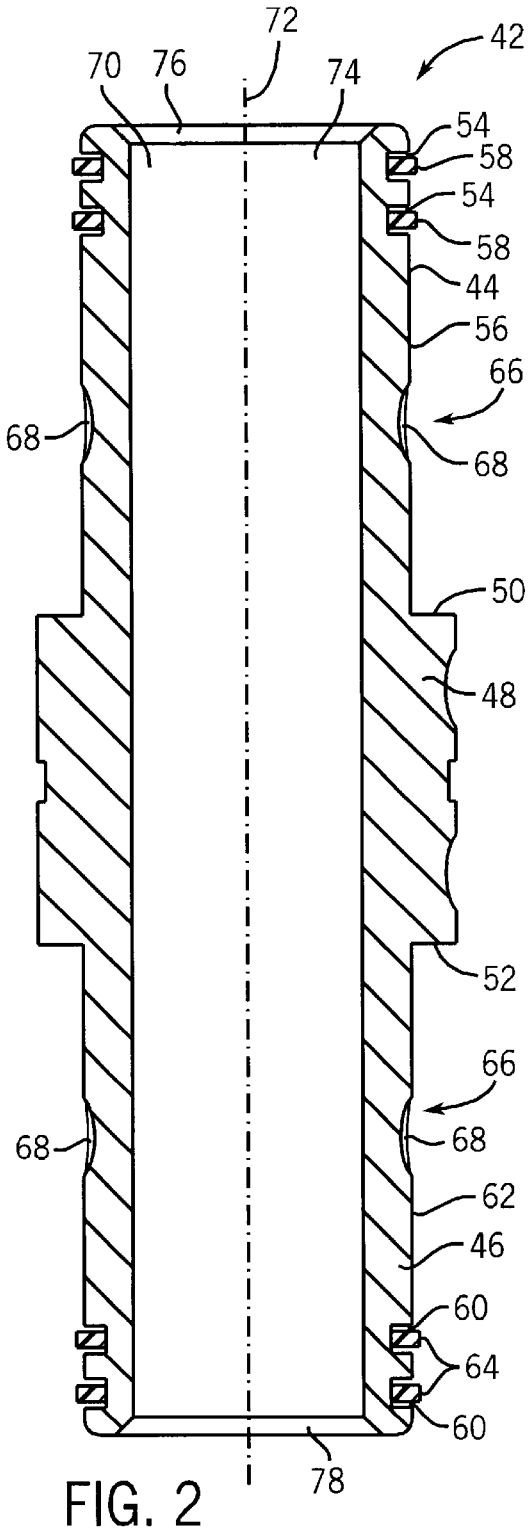
FIG. 2 is cross-sectional view taken generally along the axis of a portion of the connector system utilized in connecting sequential segments of deployment tubing having internal power cable.

Referring generally to FIG. 2, a portion of one of the connector systems 40 is illustrated. FIG. 2 shows a tubing connector 42 that permits the secure connection of the tubing 32 of one segment 38 to the tubing of the next sequential tubing segment 38. Tubing connector 42 includes a pair of nipples or inserts, referred to as an upper insert 44 and a lower insert 46, sized for insertion into the hollow tubing interiors of adjacent segments 38. Tubing connector 42 also includes an expanded region 48 disposed between upper insert 44 and lower insert 46. Expanded region 48 provides an upper abutment surface 50 and a lower abutment surface 52. Upper and lower abutment surfaces 50, 52 provide a stop against which the external tubing 32 of adjacent segments 38 abut when slid over cylindrical upper insert 44 and cylindrical lower insert 46.

Preferably, each tubing connector 42 includes one or more seals disposed to prevent liquid flow between tubing connector 42 and an attached deployment system segment 38. In the illustrated embodiment, upper insert 44 includes a pair of annular grooves 54 formed in an external surface 56. A sealing member 58, such as an elastomeric seal, is disposed in each groove 54 to encircle upper insert 44 and to provide a liquid-tight seal between upper insert 44 and a connected segment 38.

Similarly, lower insert 46 includes a pair of annular grooves 60 formed in an exterior surface 62. A sealing member 64, such as an elastomeric seal, is disposed in each annular groove. Seal members 64 provide a liquid-tight seal between lower insert 46 and a connected segment 38. It should be noted that the actual number of seal members 58, 64 may be one or more depending on such factors as tubing connector design and application of the overall deployment system.

Additionally, a retention system 66 is used to ensure that segments 38 remain connected to tubing connector 42 during deployment and use of downhole system 12. In the illustrated embodiment, retention system 66 includes a plurality of dimples 68 formed in exterior surface 56 of upper insert 44 and exterior surface 62 of lower insert 46. Dimples 68 permit the slight deformation of the coiled tubing 32 of each segment 38 once attached to tubing connector 42. The sidewall of each section of tubing 32 is appropriately deformed in a radially inward direction such that it deforms into dimples 68 (see FIG. 4) to prevent the attached segment 38 from inadvertently sliding off the upper insert 44 or lower insert 56 to which it is attached.

Tubing connector 42 also includes a hollow interior 70 that preferably extends generally along a longitudinal axis 72. Hollow interior 70 is defined by an interior wall surface 74 that extends between an upper opening 76 and a lower opening 78.

Figure 3:
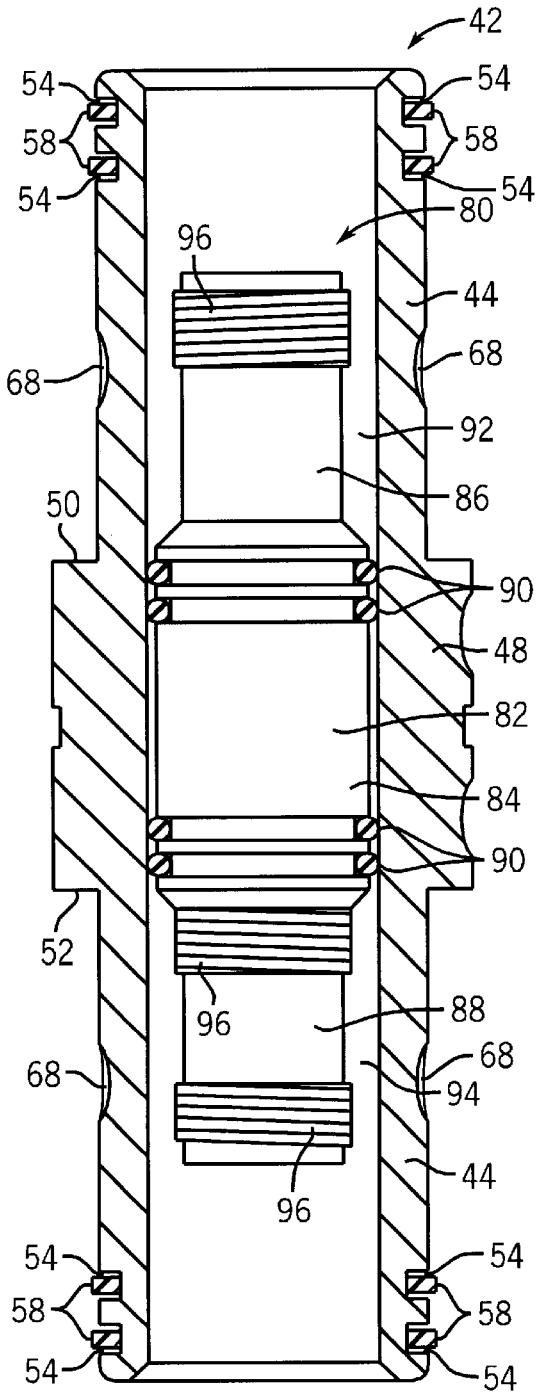
FIG. 3 is a cross-sectional view similar to that of FIG. 2 but showing an internal electrical feed-through, according to one embodiment of the present invention.

Hollow interior 70 is sized to receive an electrical feed-through 80, as illustrated in FIG. 3. Feed-through 80 is designed for connection to the internal power cable 34 included in each segment 38. Thus, each connector system 40 includes a tubing connector 42 and an electrical feed-through 80 to couple sequential segments 38 both mechanically and electrically.

In the illustrated embodiment, feed-through 80 includes an outer housing 82 that may be formed from a suitable metal or plastic. Outer housing 82 includes a midsection 84, an upper plug portion 86 and a lower plug portion 88. In the exemplary embodiment, midsection 84 has a larger diameter than upper plug portion 86 or lower plug portion 88. The diameter of midsection 84 may be slightly less than the diameter of interior surface 74 to permit feed-through 80 to be slid into the center of hollow interior 70. Additionally, one or more annular seals, such as O rings, may be disposed about midsection 84 to form a seal between feed-through 80 and interior surface 74 of tubing connector 42.

Preferably, upper plug portion 86 and lower plug portion 88 are generally cylindrical in shape and have a smaller diameter than midsection 84. In the illustrated design, the smaller diameter of the plug portions facilitates the selective, pluggable connection with sections of power cable disposed within adjacent segments 38. Specifically, the smaller diameter of upper plug portion 86 provides for the formation of an annular space 92 between upper plug portion 86 and interior surface 74. Similarly, the size and shape of lower plug portion 88 provides for the formation of an annular space 94 between plug portion 88 and interior surface 74. Additionally, each plug portion 86, 88 may include regions that facilitate the secure connection between feed-through 80 and adjacent power cable sections. For example, each plug portion may include one or more regions of ridges 96 or other surface abnormalities to help maintain secure mechanical and electrical connection.

Figure 4:
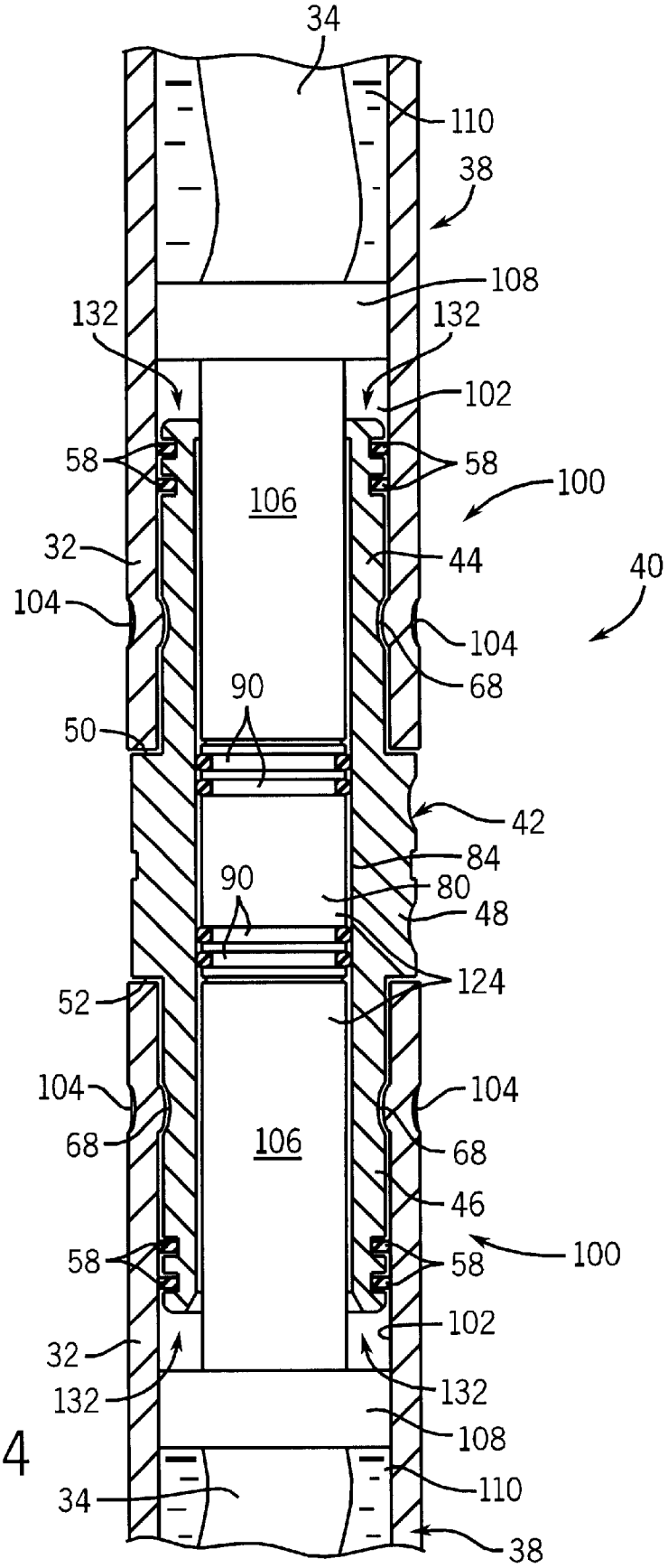
FIG. 4 is a partial cross-sectional view showing the connector system components of FIG. 3 connecting sequential segments of coiled tubing.

Referring generally to FIG. 4, an entire exemplary connector system 40 is illustrated. Each segment 38 includes an outer section of tubing 32, preferably coiled tubing, and an internal power cable section 34. Each modular segment includes a segment connector end 100 designed for both mechanical and electrical connection into connector system 40.

As illustrated, the coiled tubing 32 of each connector end 100 has an interior surface 102 of appropriate size to permit sliding engagement with either upper insert 44 or lower insert 46. Preferably, a retention system is used to maintain secure connection between tubing segment 38 and either upper insert 44 or lower insert 46. In the exemplary embodiment, a plurality of tubing dimples 104 are formed in the tubing sidewall of each tubing segment 38 such that the tubing material, typically steel, is deformed into dimples 68 of tubing connector 42.

Additionally, each section connector end 100 includes an electrical connector, such as a plug 106, that is electrically connected with the corresponding power cable section 34. In the exemplary embodiment, each plug 106 is sized for insertion into hollow interior 70 to achieve mating engagement with the corresponding plug portion 86 or 88. Preferably, the length of plug 106 is selected to permit an end of tubing 32 for each segment 38 to lie proximate or against the corresponding abutment surface 50 or 52 when the plug 106 is engaged with its corresponding plug portion of feed-through 80.

Although a variety of plug styles may be selected, the illustrated plug is sized and designed such that it can slide into hollow interior 70 and along annular space 92 or 94 as it engages upper plug portion 86 or lower plug portion 88, respectively. Generally, each plug 106 is disposed adjacent midsection 84 when fully engaged.

It is preferred that each plug 106 be mounted securely in its corresponding section connector end 100. Accordingly, each plug 106 may be connected to tubing 32 by a connection block 108. Connection block 108 may have a variety of forms, including epoxy blocks or metallic blocks that are mounted in place via appropriate notches and grooves, ring clips disposed above and beneath the connection block, set screws extending through tubing 32, etc. In some applications, it also may be desirable to seal connection block 108 against interior surface 102 of tubing 32 by appropriate O rings or other seals (not shown). By forming an appropriate seal between each connection block 108 and tubing 32, the interior of each tubing section 32, intermediate connection blocks 108, can be filled with a buoyancy fluid 110 having a specific gravity selected to support power cable 34 within tubing 32. However, a variety of mechanical power cable anchors and supports can be utilized to support the power cable, as with conventional systems.

A variety of connectors, including other types of plug connectors, can be used for forming the connection between power cable 44 and electrical feed-through 80 to ensure, for example, power delivery to submergible motor 18. In a typical power delivery system, the connectors, e.g. plugs, must be designed to facilitate the transfer of three-phase power, typically through three or more conductors. An exemplary plug connector system is illustrated in FIGS. 5 through 8.

Figure 5:
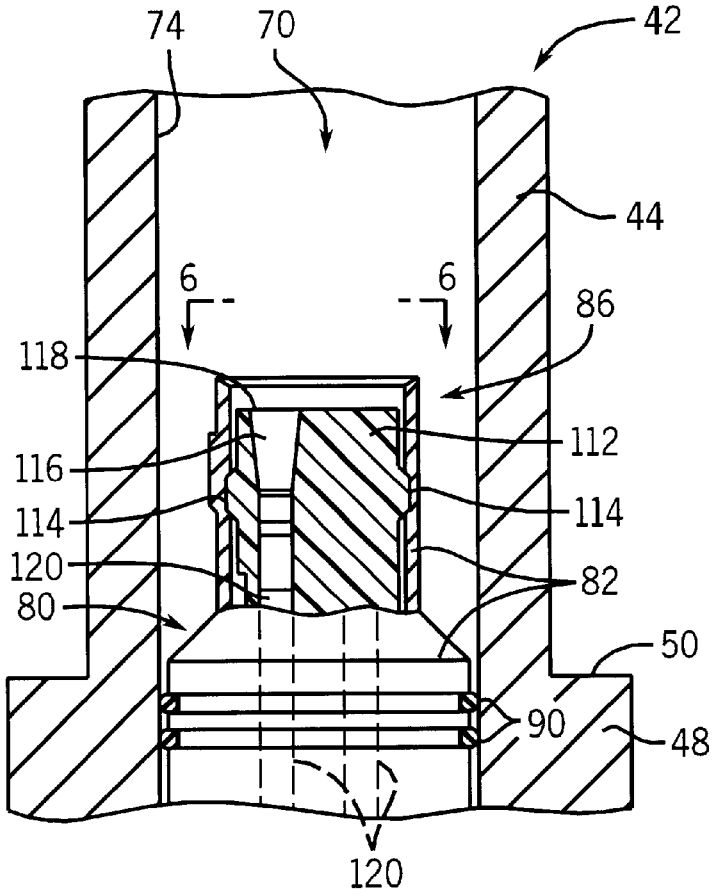
FIG. 5 is a partial cross-sectional view of the electrical feed-through showing an exemplary plug portion.
Figure 6:
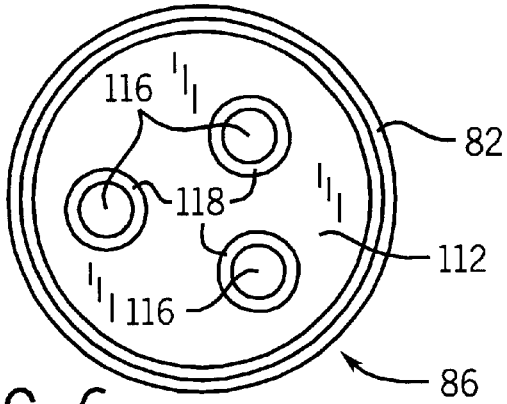
FIG. 6 is a top view of the plug portion illustrated in FIG. 5.

Referring first to FIGS. 5 and 6, an exemplary upper plug portion 86 is illustrated. It should be noted that the description of upper plug portion 86 also applies to lower plug portion 88. As illustrated, upper plug portion 86 is a female plug having an exterior defined by outer housing 82. Within outer housing 82, plug portion 86 includes an inner support material 112, such as an insulative plastic plug material. The support material 112 may be connected to housing 82 by appropriate tabs 114 designed to engage corresponding features formed in housing 82. Additionally, support material 112 is designed to support a plurality, e.g. three, conductive receptacles 116.

Each conductive receptacle 116 preferably includes a tapered inlet region 118 to facilitate the insertion of corresponding conductive prongs, as will be described below. Each tapered inlet 118 is formed from a conductive material that is typically a conductive metallic material. Furthermore, each tapered inlet 118 is connected to a conductor 120 that passes longitudinally through feed-through 80 to corresponding conductive receptacles in lower plug portion 88.

Figure 7:
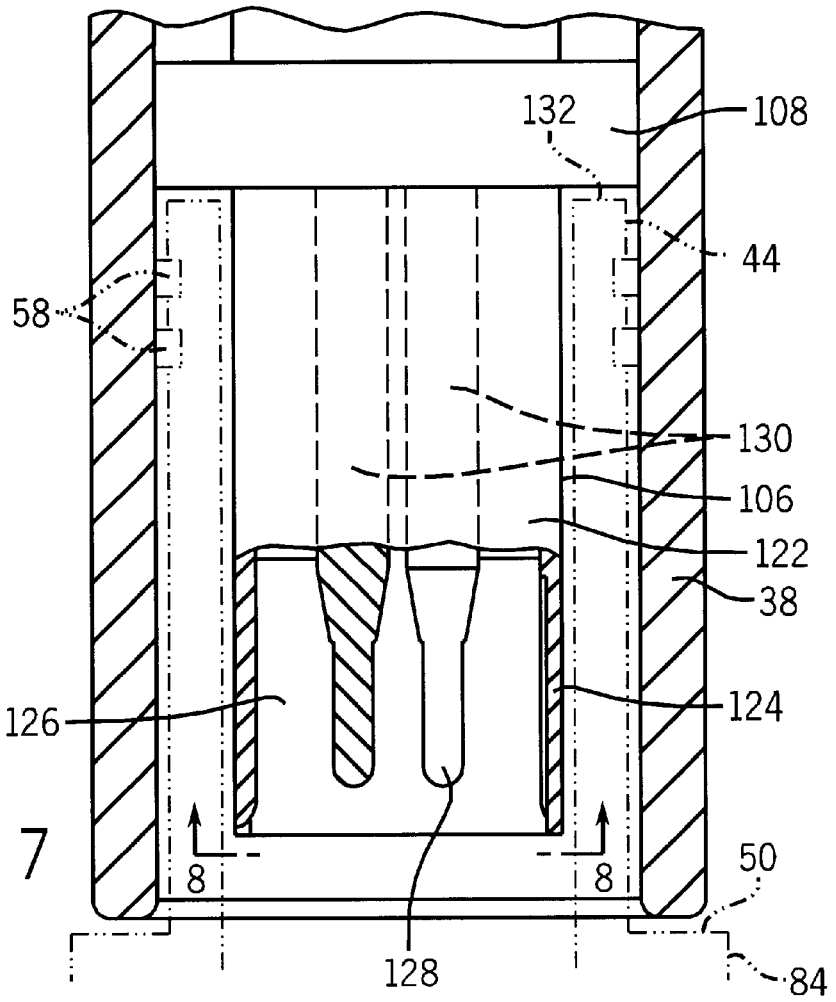
FIG. 7 is a partial cross-sectional view of the end of a tubing segment showing the plug portion designed for selective engagement with the plug portion illustrated in FIGS. 5 and 6.
Figure 8:
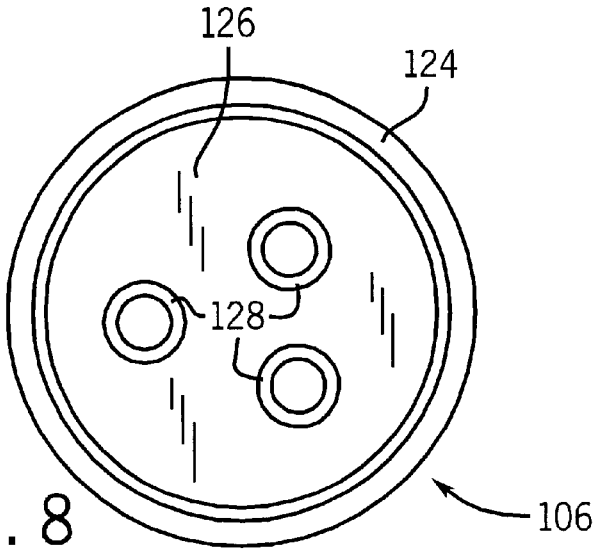
FIG. 8 is a bottom view of the tubing segment plug illustrated in FIG. 7.

Referring now to FIGS. 7 and 8, an exemplary plug 106 is illustrated as designed for mating engagement with a corresponding plug portion 86 or 88 of electric feed-through 80. As illustrated, each plug is defined by a plug housing 122 having an annular end portion 124 defining a hollow end region 126. A plurality of prongs 128 extend into hollow end region 126 to form a male plug portion designed for mating engagement with, for example, upper plug portion 86.

In the specific example illustrated, there are three prongs 128 properly arranged to slide into corresponding conductive receptacles 116 when the tubing segment 38 is inserted into engagement with upper insert 44 or lower insert 46. Prongs 128 typically are metallic prongs electrically connected to corresponding conductors 130 that extend through plug 106 and power cable 34.

During coupling of adjacent modular segments 38, prongs 128 are slid into receptacles 116 as annular end portion 124 slides into either annular space 92 or 94. Simultaneously, insert 44 or 46 slides into an annulus 132 formed between plug 106 and tubing 32 at section connector end 100. Thus, a plurality of modular segments can be connected and/or disconnected relatively simply and easily by inserting (or removing) the connector inserts 44, 46 into adjacent section connector ends 100 of sequential modular segments.

The use of a connector system 40 permits ready repair of coiled tubing, combination of multiple lengths of tubing, and the manufacture of standardized lengths of coiled tubing segments that may be mounted on a wider variety of deployment equipment. The modular coiled tubing segments simply can be plugged together to deploy a given system, such as electric submergible pumping system 12, to a desired depth within the wellbore.

It will be understood that the foregoing description is of preferred exemplary embodiments of this invention, and that the invention is not limited to the specific forms shown. For example, a variety of electrical connectors can be utilized; various retention systems may be used to maintain a solid connection between modular tubing sections and connectors during deployment; the male and female plugs can be reversed; a variety of materials may be used in forming the electrical feed-through and the tubing connector; and the components may be made in a variety of sizes and diameters. Additionally, locational language, such as "upper" and "lower", is used in the description above is only to facilitate explanation of the illustrated embodiment, and it should not be construed as limiting the scope of the invention. These and other modifications may be made in the design and arrangement of the elements without departing from the scope of the invention as expressed in the appended claims.

What is claimed is:

1. A connector system for connecting sections of tubing used in deploying a device for production of a fluid, comprising:

a tubing connector having an upper nipple section sized for receipt in a first tubing end and a lower nipple section sized for receipt in a second tubing end, the tubing connector having a hollow interior; and an electrical feed-through disposed in the hollow interior, the electrical feed-through having a first connection end, a second connection end, and a plurality of conductors extending between the first and the second connection ends.

2. The connector system as recited in claim 1, wherein the tubing connector includes an expanded midsection having a first abutment surface against which the first tubing end may abut and a second abutment surface against which the second tubing end may abut.

3. The connector system as recited in claim 2, further comprising a plurality of external seals disposed about the tubing connector.

4. The connector system as recited in claim 1, wherein the first connection end comprises a first plug portion having a plurality of receptacles, each receptacle being coupled to a corresponding conductor of the plurality of conductors.

5. The connector system as recited in claim 3, further comprising a plurality of internal seals disposed between the tubing connector and the electrical feed-through.

6. The connector system as recited in claim 4, wherein the second connection end comprises a second plug portion having a plurality of receptacles, each receptacle being coupled to a corresponding conductor of the plurality of conductors.

7. The connector system as recited in claim 1, wherein the upper nipple section includes a plurality of external dimples to permit interlocking engagement with the first tubing end.

8. The connector system as recited in claim 1, wherein the lower nipple section includes a plurality of external dimples to permit interlocking engagement with the second tubing end.

9. The connector system as recited in claim 7, wherein the lower nipple section includes a plurality of external dimples to permit interlocking engagement with the second tubing end.

10. The connector system as recited in claim 1, wherein the plurality of conductors include three conductors to permit the use of three-phase power.

11. A coiled tubing connection system, comprising:

a first segment of coiled tubing having a first connector end and a first hollow interior;

a first power cable disposed in the first hollow interior and having a first plug proximate the first connector end;

a second segment of coiled tubing having a second connector end and a second hollow interior;

a second power cable disposed in the second hollow interior and having a second plug proximate the second connector end; and a coiled tubing connector having a housing sized to selectively engage the first connector end and the second connector end, the coiled tubing connector further including an internal plug assembly positioned to conductively engage the first plug and the second plug when the first and second connector ends are engaged with the coiled tubing connector.

12. The coiled tubing connection system as recited in claim 11, wherein the housing includes a pair of nipple sections sized for insertion into the first connector end and the second connector end.

13. The coiled tubing connection system as recited in claim 12, wherein the housing includes an expanded midsection disposed intermediate the first connector end and the second connector end.

14. The coiled tubing connection system as recited in claim 13, wherein the coiled tubing connector includes at least one seal disposed about each nipple section.

15. The coiled tubing connection system as recited in claim 14, wherein the coiled tubing connector includes an internal seal disposed between the housing and the internal plug assembly.

16. The coiled tubing connection system as recited in claim 11, wherein the internal plug assembly includes opposed female plug ends having receptacles arranged to receive the first plug and the second plug.

17. The coiled tubing connection system as recited in claim 11, wherein the internal plug assembly includes opposed plug ends in which at least one of the opposed plug ends comprises a female plug end.

* * * * *